US008528941B2

(12) United States Patent
Dörfler et al.

(10) Patent No.: US 8,528,941 B2
(45) Date of Patent: Sep. 10, 2013

(54) SECURITY ELEMENT HAVING A LASER MARKING

(75) Inventors: Walter Dörfler, München (DE); Michael Bauer, Maisach (DE)

(73) Assignee: Giesecke & Devrient GmbH (DE)

( * ) Notice: Subject to any disclaimer, the term of this patent is extended or adjusted under 35 U.S.C. 154(b) by 1305 days.

(21) Appl. No.: 12/299,924

(22) PCT Filed: Apr. 26, 2007

(86) PCT No.: PCT/EP2007/003691

§ 371 (c)(1),
(2), (4) Date: Nov. 7, 2008

(87) PCT Pub. No.: WO2007/128426

PCT Pub. Date: Nov. 15, 2007

(65) Prior Publication Data

US 2009/0127844 A1 May 21, 2009

(30) Foreign Application Priority Data

May 10, 2006 (DE) ..... 10 2006 021 961

(51) Int. Cl.
*B42D 15/00* (2006.01)

(52) U.S. Cl.
USPC ..... 283/85

(58) Field of Classification Search
USPC ..... 283/85
See application file for complete search history.

(56) References Cited

U.S. PATENT DOCUMENTS

| | | | | |
|---|---|---|---|---|
| 4,523,777 | A | 6/1985 | Holbein et al. | |
| 4,732,410 | A | 3/1988 | Holbein et al. | |
| 4,766,026 | A | 8/1988 | Lass et al. | |
| 6,357,800 | B1 | 3/2002 | Muller et al. | |
| 2003/0136847 | A1 | 7/2003 | Braun | |
| 2004/0155150 | A1 * | 8/2004 | Krohmer et al. | 244/130 |
| 2006/0163361 | A1 | 7/2006 | Franz et al. | |
| 2009/0127844 | A1 * | 5/2009 | Dorfler et al. | 283/85 |
| 2010/0194091 | A1 * | 8/2010 | Heim et al. | 283/85 |
| 2012/0223516 | A1 * | 9/2012 | Waumans et al. | 283/85 |

FOREIGN PATENT DOCUMENTS

| | | | |
|---|---|---|---|
| CA | 2 650 882 | A1 | 11/2007 |
| DE | 30 48 733 | A1 | 7/1982 |
| DE | 10 2006 021 961 | A1 | 11/2007 |
| EP | 0219011 | A2 | 4/1987 |
| WO | WO 9809825 | A1 | 3/1998 |
| WO | WO 0162509 | A1 | 8/2001 |
| WO | WO 0222376 | A1 | 3/2002 |
| WO | WO 2004020217 | A1 | 3/2004 |

* cited by examiner

*Primary Examiner* — Casandra Davis
(74) *Attorney, Agent, or Firm* — The Webb Law Firm

(57) ABSTRACT

The present invention relates to a security element for security papers, value documents and the like, having a laser-markable transparent or translucent marking layer into which, through the action of laser radiation, visually perceptible identifiers are introduced in the form of patterns, letters, numbers and/or images. The identifiers each comprise a lamellar structure composed of a plurality of substantially parallel lamella that extend into the depth of the marking layer and include the parameters color, width, height, lateral orientation, tilt angle and/or spacing.

28 Claims, 5 Drawing Sheets

SECURITY ELEMENT HAVING A LASER MARKING

BACKGROUND OF THE INVENTION

1. Field of the Invention

The present invention relates to a security element for security papers, value documents and the like, having a laser-markable transparent or translucent marking layer into which, through the action of laser radiation, visually perceptible identifiers in the form of patterns, letters, numbers or images are introduced. The present invention also relates to a security paper and a data carrier having such identifiers, and a manufacturing method for a corresponding security element, security paper or a corresponding data carrier.

2. Description of the Related Art

Identification cards, such as credit cards or personal identity cards, have long been provided with an individual identifier by means of laser engraving. In marking by laser engraving, through suitable guidance of a laser beam, the optical properties of the card material are irreversibly changed in the form of a desired marking. For example, in publication DE 30 48 733 A1 is described an identification card having applied information and exhibiting, on one surface, different colored layer regions that are stacked and that are at least partially interrupted by visually perceptible personalization data.

In addition to identification cards, also other value documents that are at risk of counterfeiting, such as banknotes, stocks, bonds, certificates, vouchers, checks, admission tickets, but also security elements for application to such data carriers, are often provided with laser-generated, individualizing marks, such as a serial number.

SUMMARY OF THE INVENTION

Accordingly, one object of the present invention is to provide a security element of the kind mentioned above, exhibiting laser-generated identifiers of high counterfeit security. To further increase the security and perceptibility, the identifiers are intended to exhibit especially a viewing-angle-dependent visual appearance.

This object is solved by the security element having the features of the main claim. A security paper, a data carrier and a corresponding manufacturing method are specified in the coordinated claims. Developments of the present invention are the subject of the dependent claims.

According to the present invention, the identifiers of a generic security element each comprise a lamellar structure composed of a plurality of substantially parallel lamella that extend into the depth of the marking layer and that are characterized by the parameters color, width, height, lateral orientation, tilt angle and spacing.

Here, according to a preferred variant of the present invention, the marking layer is arranged on an opaque base layer whose intrinsic color is at least partially perceptible when viewed parallel to the lamella of a lamellar structure. According to another likewise preferred variant of the present invention, the marking layer is arranged on a transparent or translucent base layer such that the security element is at least partially light-transmitting when viewed parallel to the lamella of a lamellar structure. The security element can then be used, for example, over a transparent region of a data carrier, or it can, at certain viewing directions, reveal the view of a data carrier lying thereunder.

The marking layer can also be arranged between the base layer and an effect ink layer, since, as explained in greater detail below, the identifier need not begin on the surface of the security element, but rather, through suitable choice of the laser parameters, can also be introduced in a deeper region of the security element. For this, the wavelength, intensity and focus of the laser radiation, for example, are set such that the threshold for a visually perceptible change in the laser-exposed material is exceeded only in the desired layer depth.

In an advantageous embodiment, the lamellar structures of different identifiers differ at least in their lateral orientation in order to achieve a different visual appearance upon a rotation of the security element.

Additionally or alternatively, the lamellar structures of different identifiers can differ at least in their tilt angle in order to achieve a different visual appearance upon a tilting of the security element.

The lamellar structures of different identifiers can also differ in at least one of the parameters color, width, height and spacing to produce regions having a different visual appearance within the security element. These parameter differences can be combined with different tilt angles or different lateral orientations. The lamellar structures of different identifiers can, for example, also be staggered.

According to a preferred embodiment of the present invention, the height of at least a portion of the lamella is less than the layer thickness of the marking layer. Here, the height of the lamella can be set as desired by controlling the laser energy. In particular, the lamella can begin at the base layer and reach up to a maximum height that is less than the layer thickness of the marking layer.

It is also possible to have the lamella begin at a certain height above the base layer such that, upon movement of the security element, additionally, a parallax effect occurs. This can be achieved, for example, through different laser sensitivities in different layer regions of the marking layer, or through a pre-sensitization of the material of the marking layer in some regions. The latter approach even makes it possible to easily introduce parallax images into a homogeneous layer. For this purpose, through a first lasering, visually substantially non-perceptible, pre-sensitized regions are produced in the marking layer. Here, the pre-sensitized regions can especially themselves be developed in the form of lamellar structures. Through a second lasering from another irradiation direction, visually perceptible identifiers are then produced in the overlap region within the pre-sensitized regions.

In the plane of the marking layer, the lamella can be formed in the shape of straight lines, curved lines, broken lines and/or in the shape of lines having a varying width.

According to a further advantageous embodiment of the present invention, color areas, especially gray areas, are arranged between the lamella of at least one identifier. These color areas do not change their color or gray value upon rotation and/or tilting of the security element.

It can further be provided that the identifiers of the marking layer yield, together with other identifiers of the security element, especially with identifiers imprinted on the security element, an aggregate piece of information. The aggregate piece of information is then perceptible only from certain viewing angles.

Instead of a single marking layer, also multiple marking layers can be provided, each having a layer thickness between about 50 μm and about 300 μm. The marking layers can also be spaced apart such that identifiers can be produced at different depths of the security element. For at least partially identical identifiers at different depths, a parallax effect is likewise created, since the identical identifiers are precisely stacked only from a certain viewing direction, while the identifiers appear broadened or duplicated from other viewing directions.

The lamella advantageously exhibit a height between about 50 μm and about 150 μm. Their width is limited downwards by the focus diameter of the laser beam and is preferably between about 20 μm and about 150 μm, particularly preferably between about 70 μm and about 120 μm.

The present invention also comprises a security paper for manufacturing security or value documents, such as banknotes, checks, identification cards, certificates or the like, and a data carrier, especially a branded article, a value document or the like. The security paper or the data carrier exhibits a laser-markable transparent or translucent marking layer into which, through the action of laser radiation, visually perceptible identifiers in the form of patterns, letters, numbers or images are introduced. The identifiers each comprise a lamellar structure composed of a plurality of substantially parallel lamella that extend into the depth of the marking layer and that are characterized by the parameters color, width, height, lateral orientation, tilt angle and spacing.

For this, the security paper or the data carrier can either be furnished with a security element of the kind described above, or itself provided with such identifiers. Also in the latter case, the identifiers are advantageously developed in the manner already described in greater detail above.

The present invention further comprises a method for manufacturing a security element, security paper or data carrier having a laser-markable transparent or translucent marking layer in which, through the action of laser radiation, visually perceptible identifiers in the form of patterns, letters, numbers or images are introduced into the marking layer. The identifiers are each formed having a lamellar structure composed of a plurality of substantially parallel lamella that extend into the depth of the marking layer and that are characterized by the parameters color, width, height, lateral orientation, tilt angle and spacing.

For marking, an infrared laser in the wavelength range between 0.8 μm and 3 μm, especially a Nd:YAG laser, or a related laser, such as a Nd:glass laser, a Nd:$YVO_4$ laser or the like, is preferably used. The identifiers are expediently introduced with pulsed laser radiation, for example with an output between 3 W and 150 W, preferably between 3 W and 50 W.

The lamellar structures according to the present invention can be developed to be very fine and be produced very precisely by the high precision of the beam control. The freedom of the beam control facilitates high variability of the producible identifiers, which give the designer great freedom of design. As explained, the identifiers can also be introduced into a security element, security paper or a data carrier subsequently and depth-selectively through already existing layers.

The material for the laser-markable marking layer and the laser radiation used for marking are optimally coordinated. For example, suitable laser-markable plastics, such as polyethylene (PE), polycarbonate (PC), polyethylene terephthalate (PET), polybutylene terephthalate (PBT), polyethylene naphthalate (PEN), polyproyplene (PP) and polyamide (PA), are known to the person of skill in the art. Further, the plastic can be stretched monoaxially or biaxially. The stretching of the plastic causes it, among other things, to gain polarizing properties that can be used as a further security feature. The aids required to take advantage of these properties, such as polarization filters, are known to the person of skill in the art.

Furthermore, the marking layer can also include additives that absorb laser radiation very well, such as $TiO_2$ or infrared absorbers, to be able to introduce the markings at low beam intensity.

Further exemplary embodiments and advantages of the present invention are explained below by reference to the drawings, in which a depiction to scale and proportion was omitted in order to improve their clarity.

DETAILED DESCRIPTION OF THE PREFERRED EMBODIMENTS

Figure 1:
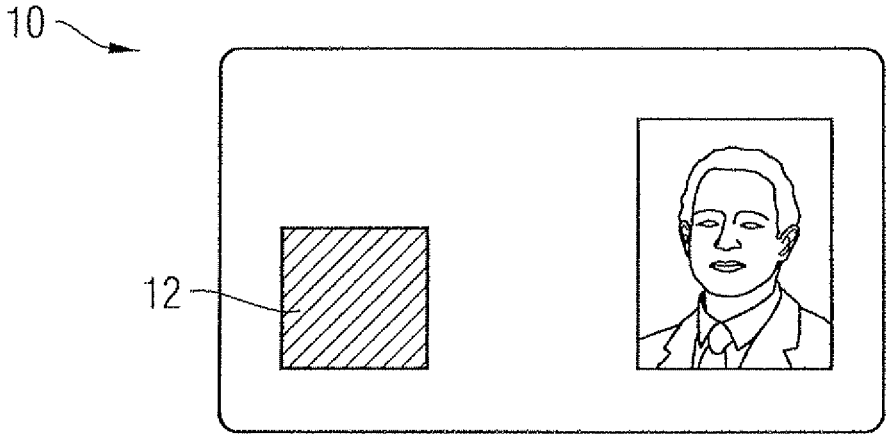
FIG. 1 is a schematic diagram of an identification card having a security element having a blind image according to an exemplary embodiment of the present invention.

The invention will now be explained using an identification card as an example. For this, FIG. 1 shows, schematically, an identification card 10 that typically includes a portrait of the cardholder and further data that is not depicted in the figure. Furthermore, for safeguarding authenticity, the identification card 10 is provided with an inventive security element 12 having a blind image that displays a different visual appearance depending on the viewing direction of the viewer.

Figure 2:
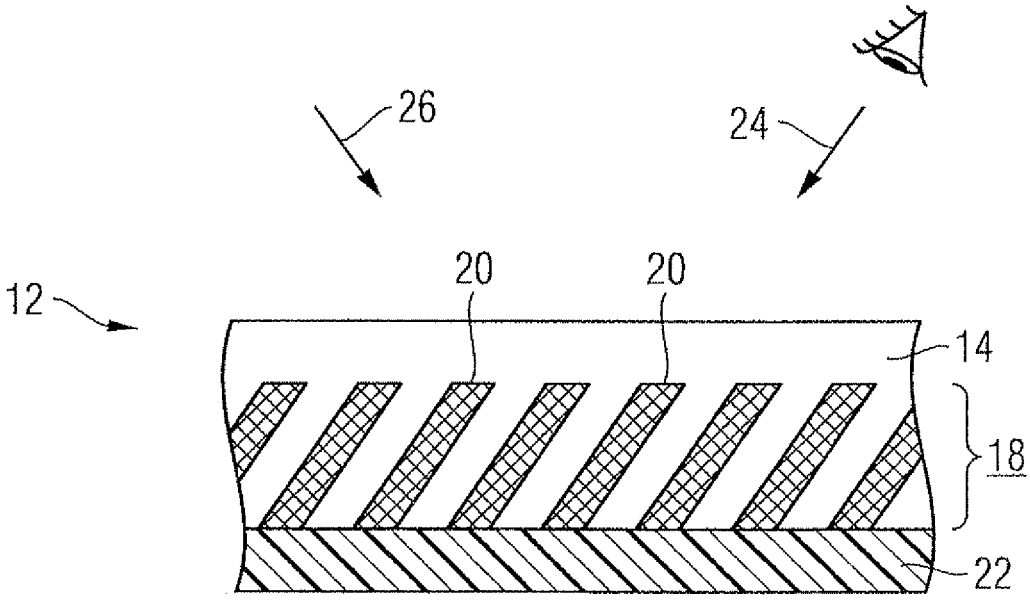
FIG. 2 is a cross-sectional view of the security element in FIG. 1.
Figure 3:
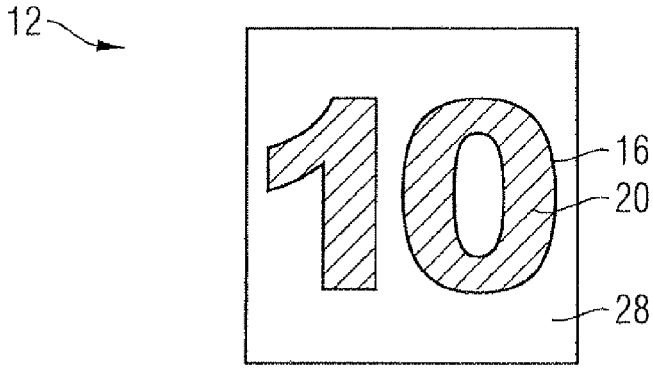
FIG. 3 is a top view of the security element in FIG. 1.

For this, as becomes clear when looking at the cross-sectional diagram in FIG. 2 and the top view in FIG. 3 together, the security element 12 exhibits a transparent marking layer 14 into which, through the action of laser radiation, at least one visually perceptible identifier 16 in the form of patterns, letters, numbers or images is introduced.

The identifier 16 exhibits a lamellar structure 18 composed of a plurality of substantially parallel lamella 20 that extend into the depth of the marking layer 14 and that is especially characterized by the parameters color, width, height, lateral orientation, tilt angle and spacing of the lamella 20. For example, in the exemplary embodiment in FIG. 2, the lamella 20 exhibit a width of about 100 μm, a spacing of about 120 μm, a tilt angle of about 50° and a height of about 150 μm. In the simplest case, only a lamellar structure is provided in the security element, and the lamella 20 of the lamellar structure 18 exhibit a uniform lateral orientation, as perceptible, for example, in the top view in FIG. 3.

The transparent marking layer 14 is arranged on an opaque base layer 22 whose intrinsic color differs considerably from the color of the lamella. For example, the base layer 22 can be formed by a white opaque card foil from which the lamella 20 stand out in contrast as laser-induced blackenings of the marking layer 14.

If the security element 12 is now viewed from one viewing direction 24 parallel to the lamella 20, then the white intrinsic color of the base layer 22 is easily perceptible between the black lamella 20. From this viewing direction, the white and black regions alternate in rapid succession such that, for the viewer, the impression is created of a uniformly gray area whose brightness depends on the chosen ratio of lamella width to lamella spacing.

From other viewing directions, such as the viewing direction 26, the tilted lamella 20 block the view of the base layer 22, as with a blind, such that the viewer perceives only a uniformly black area.

The surroundings 28 of the identifier 16 can be developed in a gray tone that corresponds to the gray tone of the identifier 16 at a certain viewing angle such that the identifier 16 is not perceptible from this viewing angle. By tilting the security element 12, the image information of the identifier 16 can be made to appear or to disappear.

Figure 4:
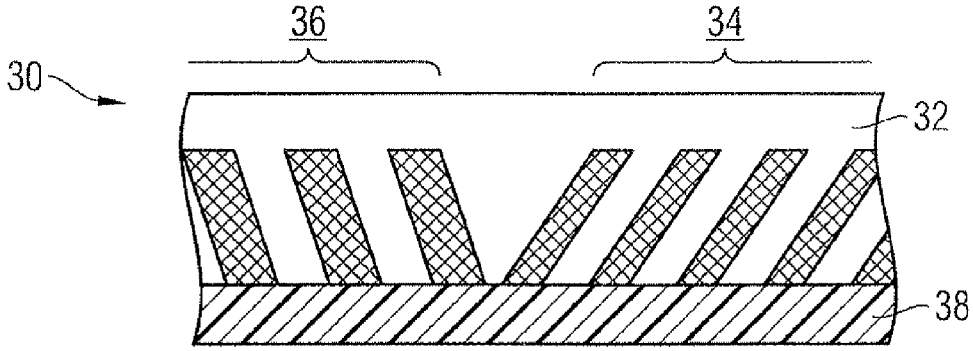
FIG. 4 is a cross-sectional view of a security element according to another exemplary embodiment of the present invention.

After this explanation of the basic principle of the present invention, in the following figures, more complex exemplary embodiments having multiple lamellar structures and/or having additional elements will now be described:

As shown in cross section in FIG. 4, the security element 30 according to another exemplary embodiment of the present invention includes a marking layer 32 having a first lamellar structure 34 that is characterized by a first set of parameters, and a second lamellar structure 36 that is characterized by a second set of parameters. Here, the first and second lamellar structure 34 or 36 differ in at least one of their characteristic parameters in order to produce a different visual appearance from different viewing directions.

As in the exemplary embodiment in FIG. 2, the base layer 38 of the security element can be opaque or also transparent or translucent. In the latter case, the security element 30 is partially transparent in viewing directions parallel to one of the lamellar structures 34, 36. This can be used to advantage, for example, for a transmitted light effect, or also only to make visible through the security element 30 a data carrier lying thereunder.

Figure 5A:
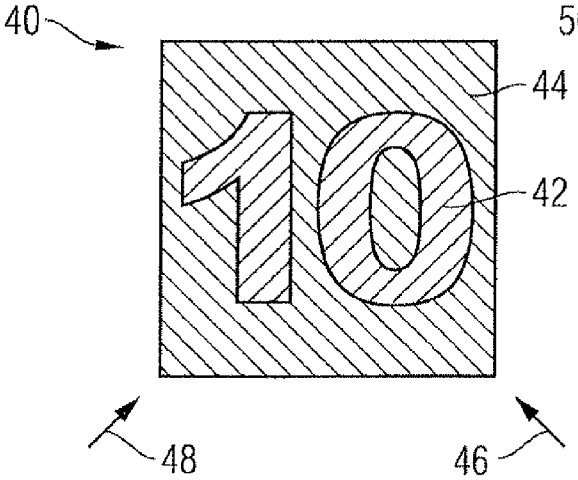
FIGS. 5*a* and 5*b* are top views of two examples of security elements having two different lamellar structures.
Figure 5B:
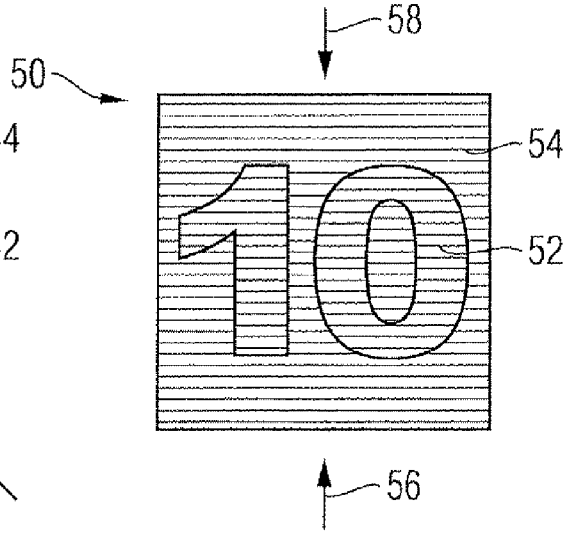

Two examples of security elements each having two different lamellar structures are depicted in the top views in FIGS. 5(*a*) and 5(*b*).

In the security element 40 in FIG. 5(*a*), at least the lateral orientation of the tilted lamella 42 and 44 differs such that the visual appearance of the inscribed identifier changes upon rotation of the security element 40. If the viewer looks at the security element, for example, from the viewing direction 46, then he looks parallel to the tilted lamella 42 and thus, in sub-regions, at the base layer arranged beneath the marking layer. The interior of the identifier "10" thus appears having a first brightness in a first color. This first image impression can especially be chosen as desired through the color of the base layer and the color, width and spacing of the lamella 42. From the viewing direction 46, the tilted lamella 44 shade the base layer for the viewer such that the surroundings of the identifier "10" appear having a second brightness in a second color, this second image impression being given substantially only by the color of the lamella 44.

Seen from the viewing direction 48, the situation reverses. The viewer now looks parallel to the lamella 44 and thus partially at the base layer, while the lamella 42 block the view of the base layer. In this way, the appearance of the security element 40 changes upon rotation in a predefined manner.

The security element 50 in FIG. 5(*b*) includes two lamellar structures whose lamella 52, 54 exhibit the same lateral orientation, but include different tilt angles with the surface normal. In this way, the security element 50 constitutes a tilt image whose visual appearance changes upon tilting about a tilt axis parallel to the lamella. For example, the lamella 52 can exhibit a tilt angle of +30°, the lamella 54 a tilt angle of −40° to the surface normal.

If the viewer looks at the security element from the viewing direction 56, then he looks parallel to the lamella 52 tilted toward him and thus, in sub-regions, at the base layer lying beneath the marking layer. The interior of the identifier "10" thus appears having a first brightness in a first color. This first image impression can, again, especially be chosen as desired through the color of the base layer and the color, width and spacing of the lamella 52.

From this viewing direction, however, the lamella 54 tilted away from the viewer shade the base layer for the viewer such that the surroundings of the identifier "10" appear having a second brightness in a second color, the second image impression being given substantially only by the color of the lamella 54.

Seen from the viewing direction 58, the situation reverses, since the viewer now looks parallel to the lamella 54 and thus partially at the base layer, while the lamella 52 block the view of the base layer. In this way, the appearance of the security element 50 changes upon tilting in a predefined manner.

Figure 6:
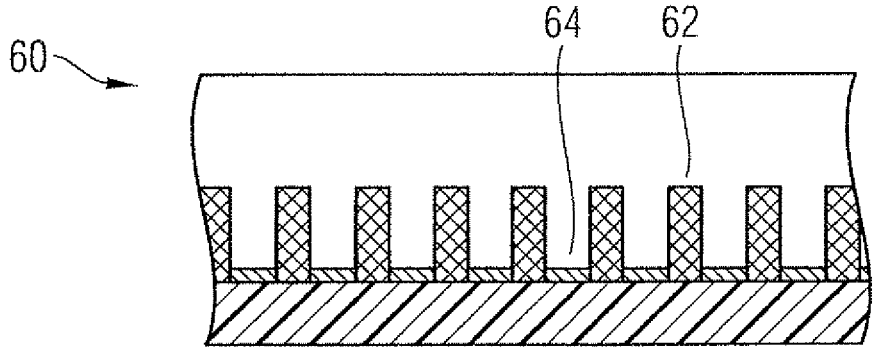
FIG. 6 is a cross-sectional view of a security element according to a further exemplary embodiment of the present invention.

In the security element 60 in FIG. 6, between the lamella 62 of an identifier are arranged gray areas 64 that retain their gray value independent of the rotation or tilt of the security element 60. Such gray areas, or more generally also any color areas, can be combined with all described lamellar structures.

Figure 7:
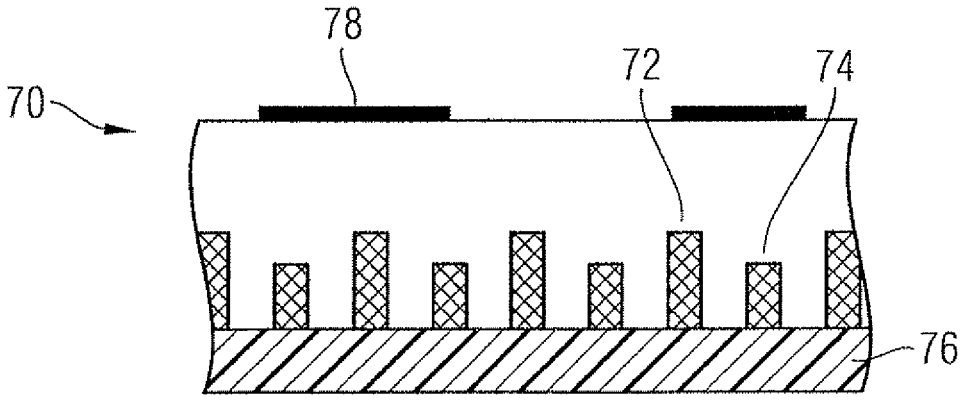
FIG. 7 is a cross-sectional view of a security element according to a further exemplary embodiment of the present invention.

The exemplary embodiment in FIG. 7 shows a security element 70 having lamella of different heights. Here, the higher lamella 72 require smaller tilt angles than the lower lamella 74 in order to shade the base layer 76. The different height of the lamella can be set at will through corresponding control of the laser energy.

FIG. 7 also illustrates a further advantage of the blind images according to the present invention. The wavelength and intensity of the laser radiation can, namely, be so chosen and coordinated with the properties of existing layers, such as an applied printing layer 78, that the lamella, such as the lamella 72 and 74, can be introduced through these layers into deeper plies of the security element without ablating the existing layers. The identifiers according to the present invention can thus also be used for the subsequent personalization or individualization of security elements or data carriers. For the laser impingement, for example infrared radiation of a pulse-operated Nd:YAG laser with an output between 3 W and 50 W can be used.

Figure 8:
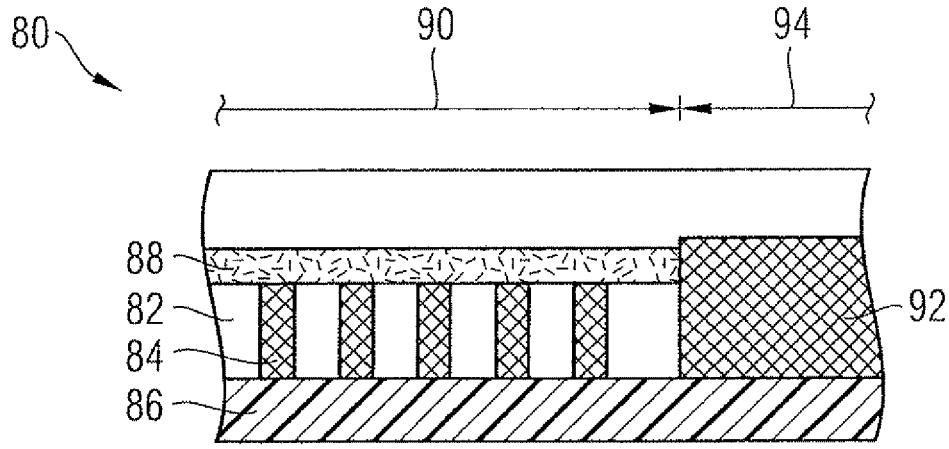
FIG. 8 is a cross-sectional view of a security element according to a further exemplary embodiment of the present invention.

The blackening of the marking layer can also occur through an effect layer, as illustrated in FIG. 8. In the exemplary embodiment in FIG. 8, the marking layer 82 of the security element 80 is arranged between a base layer 86 and an effect ink layer 88. The effect ink layer 88 can include, for example, optically variable interference pigments, thermal inks or the like.

For the impingement of the sub-region 90, the wavelength, intensity and focus of the laser radiation are chosen such that the marking layer 82 is provided with lamella 84 without destroying the effect ink layer 88. In the sub-region 90 marked in this way, then both the viewing-angle-dependent identifier and the optically variable effect of the effect ink layer are present. Of course the laser marking 92 can also be so executed in other sub-regions 94 that the effect ink layer 88 is destroyed locally such that no optically variable effect is perceptible there any longer.

Figure 9:
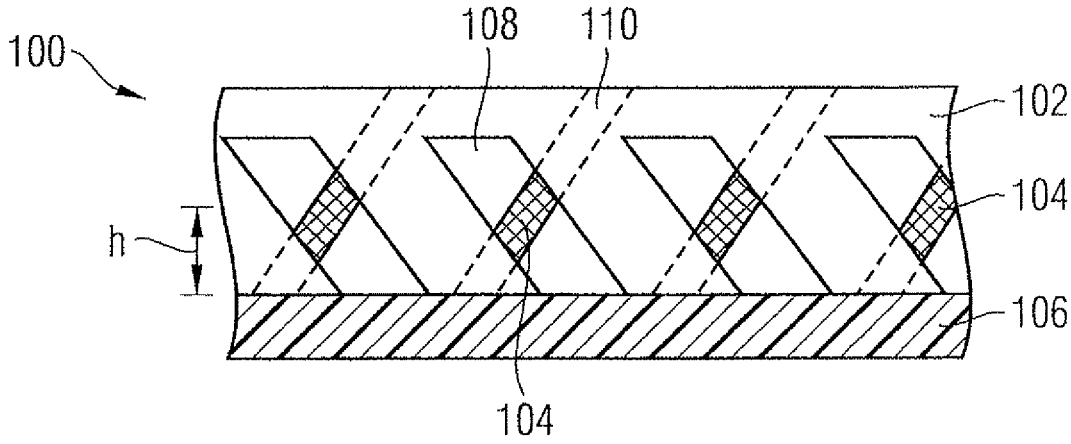
FIG. 9 is a cross-sectional view of a security element according to the present invention in which, as the identifier, a parallax image is introduced into the marking layer.
Figure 10A:
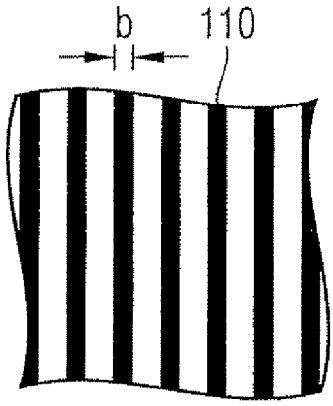
FIGS. 10*a* through 10*d* are top views of different lamellar structures according to the present invention.
Figure 10B:
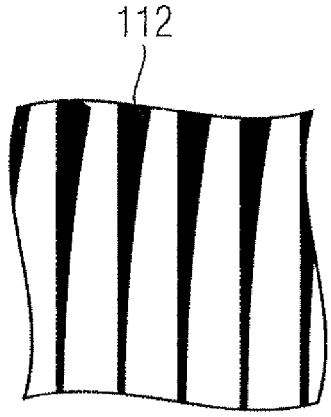
Figure 10C:
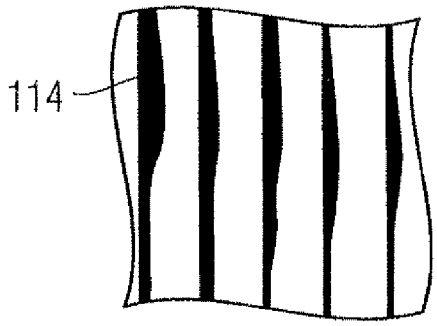
Figure 10D:
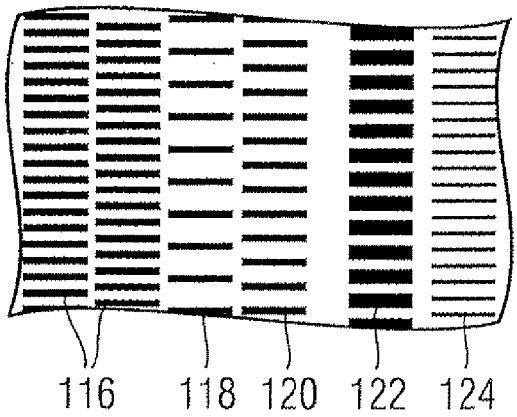

In the exemplary embodiment 100 in FIG. 9 is introduced into the marking layer 102, as the identifier, a parallax image in which the blackenings 104 are located at a certain height h above the base layer 106. Thus, upon movement of the security element, in addition to the described tilt or rotation effect, a parallax effect occurs due to the movement of the blackenings 104 against the background of the distanced base layer 106.

According to the present invention, this particular identifier is produced in that the material of the marking layer 102 is pre-sensitized by a first lasering from a certain irradiation direction. The pre-sensitized regions, which are marked in FIG. 9 with the reference number 108, are not visually perceptible themselves, but the threshold for producing a visible laser marking is reduced in them. The pre-sensitized regions advantageously include a tilt angle of about 30° to about 50° with the surface normal.

Through a second lasering 110 from a different, second irradiation direction, the material of the marking layer 102 is now blackened in the overlap areas with the pre-sensitized regions 108. Here, through a suitably set laser intensity, it can be ensured that, in the non-pre-sensitized regions, the material is not visually changed by the second lasering. Overall is created in this way a lamellar structure 104 whose vertical position within the marking layer can be chosen largely freely through the relative position of the two laserings.

The first and second lasering can occur simultaneously such that a higher laser intensity prevails in the overlap region of the laser beams than outside. Here, the laser intensities are chosen such that, individually, they are not sufficient to blacken the material, but the higher laser intensity in the overlap region is above the blackening threshold.

However, the second lasering can also occur temporally after the first lasering. In this case, without the precise processes in the material being important for the present invention, through the first lasering, the blackening threshold of the material is reduced in the pre-sensitized regions, wherein this change itself is not visually perceptible. For the second lasering, the laser intensity is now chosen such that it is above the blackening threshold of the pre-sensitized material, but below the blackening threshold of the non-modified material. In this way, too, the desired effect is achieved.

In all described exemplary embodiments, the lamella of the identifiers can be developed to be straight and having a constant width. FIG. 10(*a*) shows a top view of such a lamellar structure having straight lamella 110 and a constant width b. The achievable width of the lamella is given downwards by the focus diameter of the laser used for marking. The focus diameter is typically between 20 μm and 150 μm, preferably between 70 μm and 120 μm, such that corresponding lamella widths b result. In the same way, lamellar structures can be used that form curved lines in the plane of the marking layer.

FIG. 10(*b*) and FIG. 10(*c*) schematically show exemplary embodiments of lamellar structures having lamella 112 and 114 having a changing width. In this way, upon viewing parallel to the lamella, the visible portion of the base layer changes such that the brightness impression varies along the lamella. It is understood that, unlike in the schematic diagram in FIG. 10(*b*) and FIG. 10(*c*), in real exemplary embodiments, this change typically takes place on a considerably larger length scale compared with the spacing of adjacent lamella.

Through suitable line shapes or suitably chosen spacings of the lamella, the blind images according to the present invention can, at certain viewing angles, also depict a halftone image. For example, the different gray levels of a halftone image can be produced by lamellar structures 116, 118, 120 having parallel lamella having different spacings between the lamella, as illustrated in the left half of the image in FIG. 10(*d*). Alternatively or additionally, different gray levels can be produced by lamella of different widths in the lamellar structures 122, 124, as shown on the right in FIG. 10(*d*).

Any predefined halftone image can easily be depicted with such lamellar structures in that, for example, a small areal region of the security element is associated with each halftone image point, and this areal region is provided with a lamellar structure that corresponds to the brightness of the halftone image point. Upon viewing from a viewing direction parallel to the lamella, the halftone image is then perceptible, and from other viewing directions from which the lamella block the view of the base layer, merely a uniformly colored area is shown.

The invention claimed is:

1. A security element for security papers, value documents and the like having a laser-markable transparent or translucent marking layer into which, through an action of laser radiation, visually perceptible identifiers are introduced in the form of at least one of the following: patterns, letters, numbers, images, or any combination thereof, wherein the identifiers each exhibit a lamellar structure composed of a plurality of substantially parallel lamella that extend into a depth of the marking layer and include at least one of the following parameters: color, width, height, lateral orientation, tilt angle, spacing, or any combination thereof.

2. The security element according to claim 1, wherein the marking layer is arranged on an opaque base layer whose intrinsic color is at least partially perceptible when viewed parallel to the lamella of a lamellar structure.

3. The security element according to claim 1, wherein the marking layer is arranged on a transparent or translucent base layer, such that the security element is at least partially light-transmitting when viewed parallel to the lamella of a lamellar structure.

4. The security element according to claim 2, wherein the marking layer is arranged between the base layer and an effect ink layer.

5. The security element according to claim 1, wherein the lamellar structures of different identifiers differ at least in their lateral orientation in order to achieve a different visual appearance upon rotating the security element.

6. The security element according to claim 1, wherein the lamellar structures of different identifiers differ at least in their tilt angle in order to achieve a different visual appearance upon tilting the security element.

7. The security element according to claim 1, wherein the lamellar structures of different identifiers differ in at least one of the following parameters: color, width, height, spacing, or any combination thereof, to produce regions having a different visual appearance within the security element.

8. The security element according to claim 1, wherein the lamellar structures of different identifiers are staggered.

9. The security element according to claim 1, wherein the height of at least a portion of the lamella is less than a layer thickness of the marking layer.

10. The security element according to claim 1, wherein the lamella are formed in a plane of the marking layer in the form of at least one of the following: straight lines, curved lines, broken lines, lines having a varying width, or any combination thereof.

11. The security element according to claim 1, wherein the lamella are formed by visually perceptible identifiers within visually substantially non-perceptible regions that are pre-sensitized by the action of laser radiation.

12. The security element according to claim 11, wherein the pre-sensitized regions are developed in the form of lamellar structures.

13. The security element according to claim 1, wherein color areas are arranged between the lamella of at least one identifier.

14. The security element according to claim 1, wherein the identifiers of the marking layer, together with other identifiers of the security element, especially with identifiers imprinted on the security element, yield an aggregate piece of information.

15. The security element according to at least claim 1, further comprising at least one marking layer having a layer thickness of between 50 μm and 300 μm.

16. The security element according to claim 1, wherein the lamella exhibit a height between 50 μm and 150 μm.

17. The security element according to claim 1, wherein the width of the lamella lies between 20 μm and 150 μm.

18. A security paper for manufacturing security or value documents and the like, comprising a laser-markable transparent or translucent marking layer into which, through an action of laser radiation, visually perceptible identifiers are introduced in the form of at least one of the following: patterns, letters, numbers, images, or any combination thereof, wherein the identifiers each exhibit a lamellar structure composed of a plurality of substantially parallel lamella that extend into a depth of the marking layer and include at least one of the following parameters: color, width, height, lateral orientation, tilt angle, spacing, or any combination thereof.

19. The security paper according to claim 18, wherein the security paper is used for manufacturing at least one of the following: a banknote, a check, an identification card, a certificate, or any combination thereof.

20. A data carrier, comprising a laser-markable, transparent or translucent marking layer into which, through an action of laser radiation, visually perceptible identifiers are introduced in the form of at least one of the following: patterns, letters, numbers, images, or any combination thereof, wherein the identifiers each exhibit a lamellar structure composed of a plurality of substantially parallel lamella that extend into a depth of the marking layer and include at least one of the following parameters: color, width, height, lateral orientation, tilt angle, spacing, or any combination thereof.

21. The data carrier according to claim 20, wherein the data carrier is a branded article or a value document.

22. A method for manufacturing a security element, security paper or data carrier having a laser-markable transparent or translucent marking layer comprising: introducing into the marking layer, through an action of laser radiation, visually perceptible identifiers in the form of at least one of the following: patterns, letters, numbers, images, or any combination thereof, wherein the identifiers are each developed having a lamellar structure composed of a plurality of substantially parallel lamella that extend into a depth of the marking layer and include at least one of the following parameters: color, width, height, lateral orientation, tilt angle, spacing, or any combinations thereof.

23. The method according to claim 22, wherein an infrared laser in a wavelength range between 0.8 μm and 3 μm is used for marking.

24. The method according to claim 23, wherein the infrared laser is a Nd:YAG laser.

25. The method according to claim 22, wherein the identifiers are introduced with pulsed laser radiation.

26. The method according to claim 22, wherein, through a first action of laser radiation, visually non-visible, pre-sensitized regions are formed in the marking layer, and through a second action of laser radiation, the visually perceptible identifiers are formed in the pre-sensitized regions.

27. The method according to claim 26, wherein the first action of laser radiation is carried out from an angle of 30° to 50° to a surface normal, and the second action of laser radiation is carried out from another angle.

28. The method according to claim 26, wherein a second lasering is carried out after a first lasering.

* * * * *